US010793317B2

(12) United States Patent
Bowen

(10) Patent No.: US 10,793,317 B2
(45) Date of Patent: Oct. 6, 2020

(54) ORGANIZING ASSEMBLY WITH TRAYS MOUNTED ON A SPINDLE

(71) Applicant: Travis Bowen, Sumas, WA (US)

(72) Inventor: Travis Bowen, Sumas, WA (US)

( * ) Notice: Subject to any disclaimer, the term of this patent is extended or adjusted under 35 U.S.C. 154(b) by 113 days.

(21) Appl. No.: 16/156,816

(22) Filed: Oct. 10, 2018

(65) Prior Publication Data

US 2020/0115104 A1 Apr. 16, 2020

(51) Int. Cl.
*B65D 25/04* (2006.01)
*B65D 25/32* (2006.01)

(52) U.S. Cl.
CPC ..... *B65D 25/04* (2013.01); *B65D 25/32* (2013.01)

(58) Field of Classification Search
CPC ..... A47F 5/05; A47F 5/06; A47F 5/07; B65D 25/04; B65D 25/30; B65D 28/2891; B65D 25/2823; B65D 25/2817; B65D 25/282
See application file for complete search history.

(56) References Cited

U.S. PATENT DOCUMENTS

| | | | | |
|---|---|---|---|---|
| 3,194,403 | A * | 7/1965 | Van Horn, Jr. | A47F 5/04 211/78 |
| 3,498,471 | A * | 3/1970 | Chielbertus | A47B 49/00 211/131.1 |
| 4,901,846 | A * | 2/1990 | Lehman | B44D 3/04 206/1.8 |
| 5,669,498 | A | 9/1997 | Fierek | |
| 5,836,446 | A | 11/1998 | Vamom | |
| D426,282 | S | 6/2000 | Harmon | |
| 6,360,891 | B1 * | 3/2002 | Rideout | B25H 3/00 206/372 |
| 6,883,268 | B2 | 4/2005 | Fraser | |
| 7,159,735 | B2 | 1/2007 | Morse | |
| 7,676,983 | B2 | 3/2010 | Jenkins | |
| 9,468,200 | B1 | 10/2016 | Davis | |
| D792,103 | S | 7/2017 | Bishop | |
| 2018/0146804 | A1 * | 5/2018 | Travisono | A47F 7/285 |

* cited by examiner

*Primary Examiner* — Stephen J Castellano

(57) ABSTRACT

An organizing assembly for a cylindrical container includes a base, a spindle, and a plurality of trays. The base and the trays are circularly shaped. The base is configured to position on a bottom of a container that is cylindrically shaped, such as a bucket. The spindle is coupled to and extends axially from the base. A plurality of couplers is removably couplable to the spindle. Each of a plurality of orifices is centrally positioned in a respective tray. The orifice is positioned to insert the spindle to position respective the tray on a respective coupler. The respective tray is configured to stow and organize items of a user.

14 Claims, 6 Drawing Sheets

ORGANIZING ASSEMBLY WITH TRAYS MOUNTED ON A SPINDLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to organizing assemblies and more particularly pertains to a new organizing assembly for a cylindrical container.

BRIEF SUMMARY OF THE INVENTION

An embodiment of the disclosure meets the needs presented above by generally comprising a base, a spindle, and a plurality of trays. The base and the trays are circularly shaped. The base is configured to position on a bottom of a container that is cylindrically shaped, such as a bucket. The spindle is coupled to and extends axially from the base. A plurality of couplers is removably couplable to the spindle. Each of a plurality of orifices is centrally positioned in a respective tray. The orifice is positioned to insert the spindle to position the respective tray on a respective coupler. The respective tray is configured to stow and organize items of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
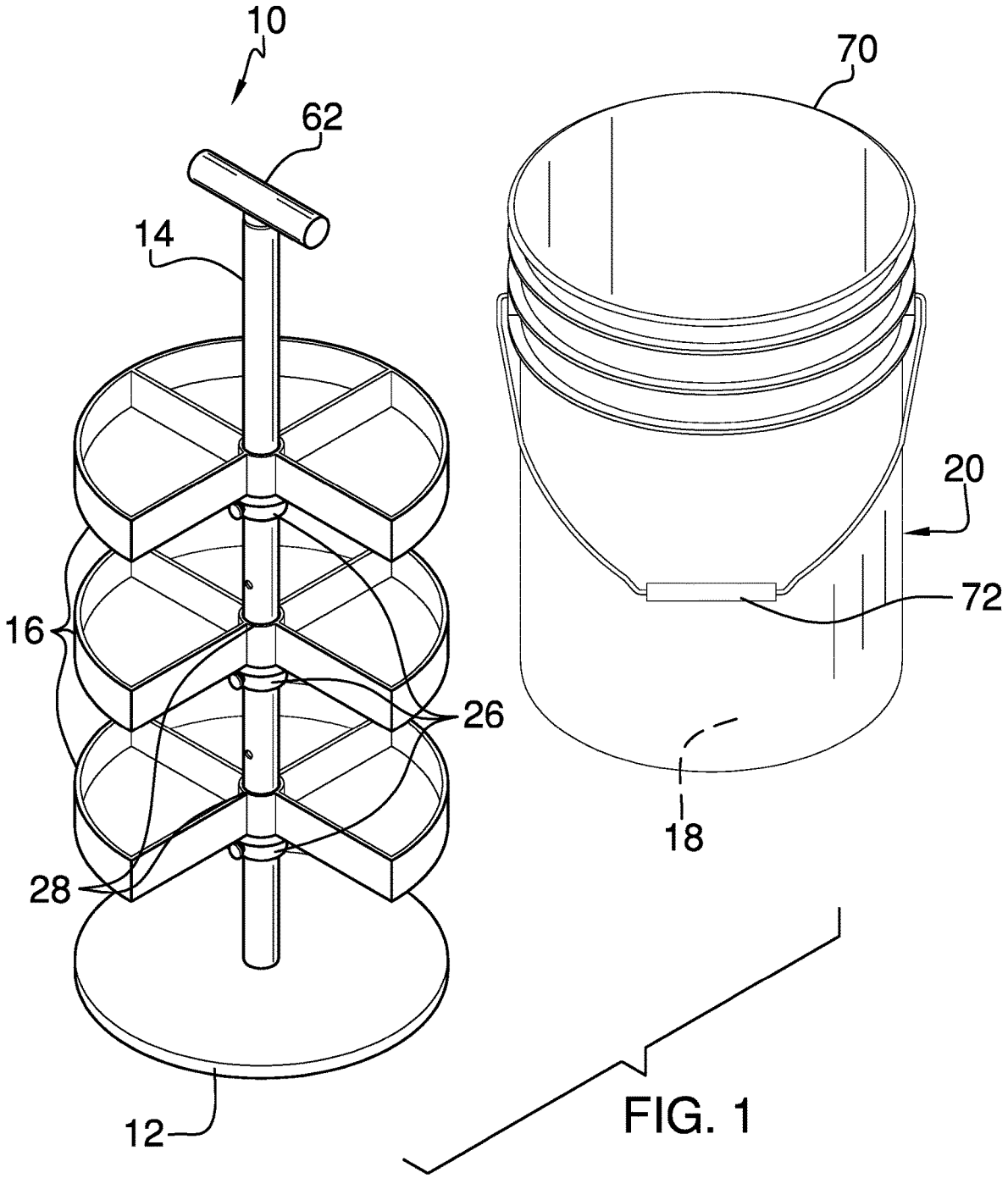
FIG. 1 is an isometric perspective view of an organizing assembly according to an embodiment of the disclosure.

With reference now to the drawings, and in particular to FIGS. 1 through 7 thereof, a new organizing assembly embodying the principles and concepts of an embodiment of the disclosure and generally designated by the reference numeral 10 will be described.

Figure 2:
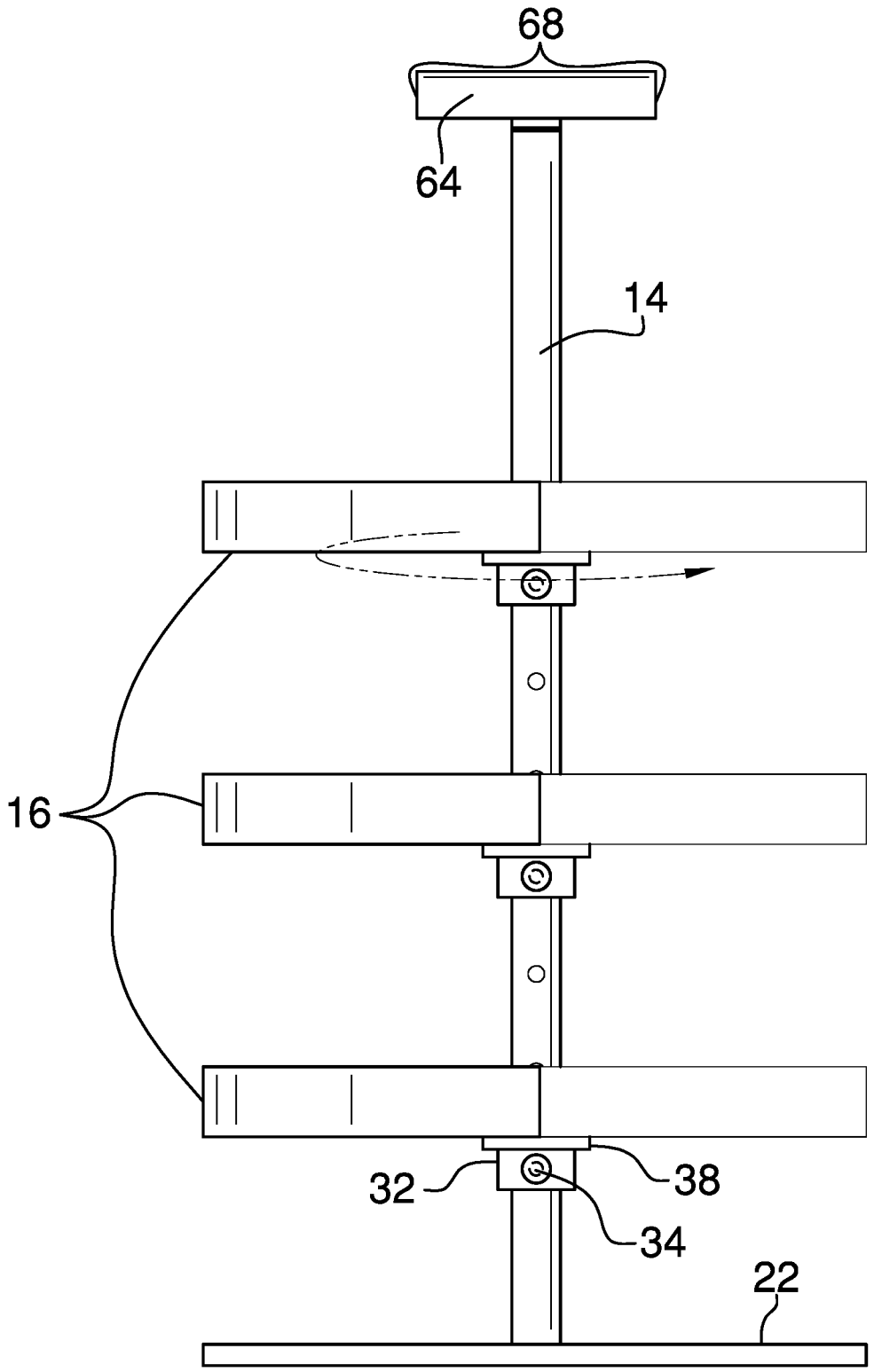
FIG. 2 is a front view of an embodiment of the disclosure.

As best illustrated in FIGS. 1 through 7, the organizing assembly 10 generally comprises a base 12, a spindle 14, and a plurality of trays 16. The base 12 and the trays 16 are circularly shaped. The base 12 is configured to position on a bottom 18 of a container 20 that is cylindrically shaped. The base 12 comprises a disc 22, as shown in FIG. 2.

The spindle 14 is coupled to and extends axially from the base 12. The spindle 14 is tubular and has an upper end 24. The spindle 14 is internally threaded adjacent to the upper end 24.

A plurality of couplers 26 is removably couplable to the spindle 14. Each of a plurality of orifices 28 is centrally positioned in a respective tray 16 so that the orifice 28 is positioned to insert the spindle 14 to position the respective tray 16 on a respective coupler 26. The respective tray 16 is configured to stow and organize items of a user.

A plurality of pairs of holes 30 is positioned in the spindle 14 so that the holes 30 of each pair of holes 30 are opposingly positioned in the spindle 14. Each coupler 26 comprises a first tube 32 and a pin 34. A pair of apertures 36 is positioned in the first tube 32 so that the pair of apertures 36 is selectively alignable with a respective pair of holes 30. The pin 34, which is detent type, is selectively positionable through the pair of apertures 36 and the respective pair of holes 30 to fixedly couple the first tube 32 to the spindle 14. The arrangement of the trays 16 on the spindle 14 is customizable to the needs of the user by sequentially positioning a coupler 26 and a tray 16 on the spindle 14 at a desired position, and then repeating for each of the trays 16 required to meet the needs of the user.

A flange 38 is coupled to and extends radially from an upper circumference 40 of the first tube 32. A bearing 42 that is recessed into an upper face 44 of the flange 38 is positioned to facilitate rotation of the respective tray 16 relative to the spindle 14.

Each tray 16 comprises a second tube 46 that is sized complementarily to the spindle 14. The second tube 46 is positioned to selectively insert the spindle 14. A panel 48 is coupled to and extends radially from a lower endpoint 50 of the second tube 46.

A cutout 52 extends between a perimeter 54 of the panel 48 and the second tube 46. With the plurality of trays 16 coupled to the spindle 14 and the assembly 10 positioned in the container 20, the cutouts 52 of adjacently positioned trays 16 can be aligned to allow the user to access items that are positioned on each tray 16 of the plurality of trays 16, as well as items that are positioned on the base 12. Additionally, as shown in FIG. 1, each tray 16 can be positioned to align the cutouts 52. With the assembly 10 positioned in the container 20, this arrangement allows a longer article to be stowed in the container 20.

Figure 3:
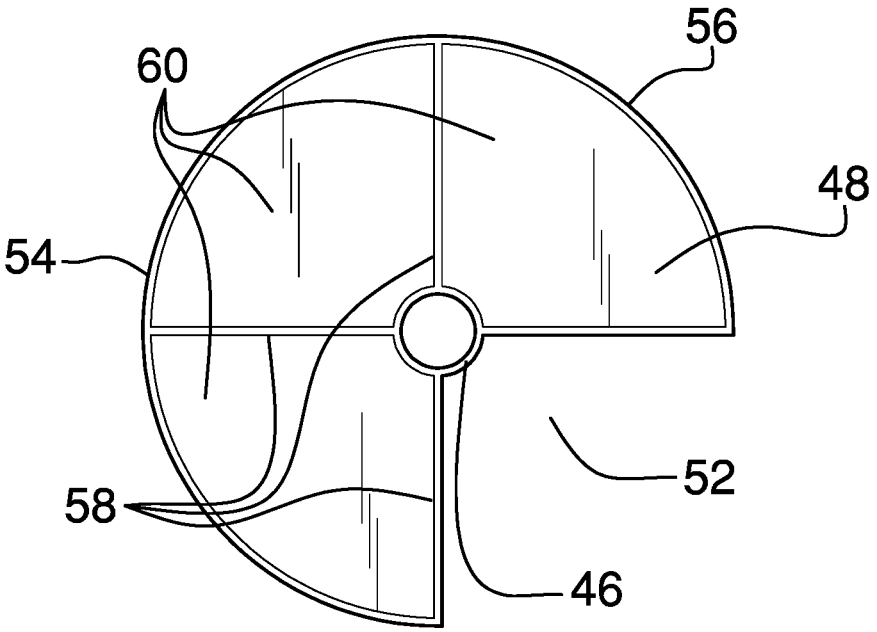
FIG. 3 is a top view of an embodiment of the disclosure.
Figure 4:
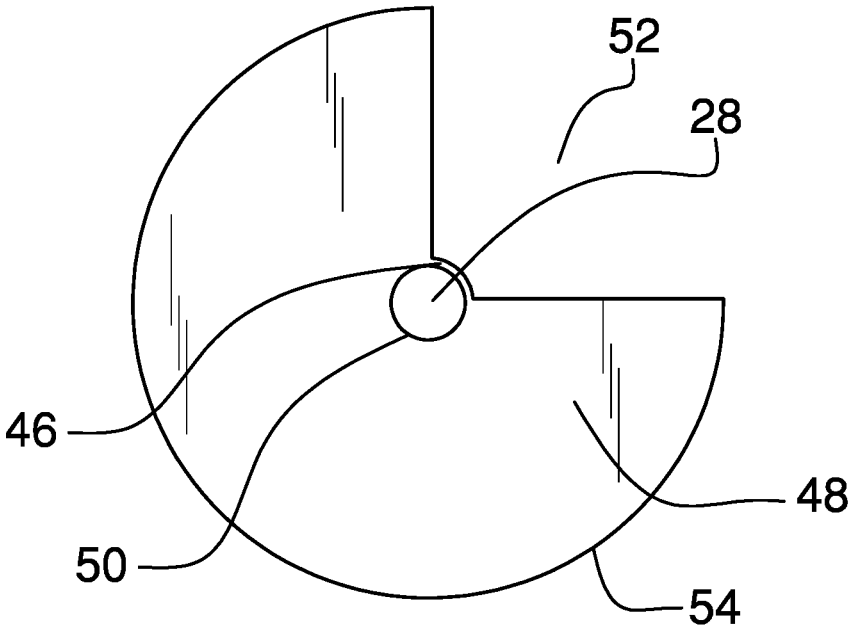
FIG. 4 is a bottom view of an embodiment of the disclosure.
Figure 5:
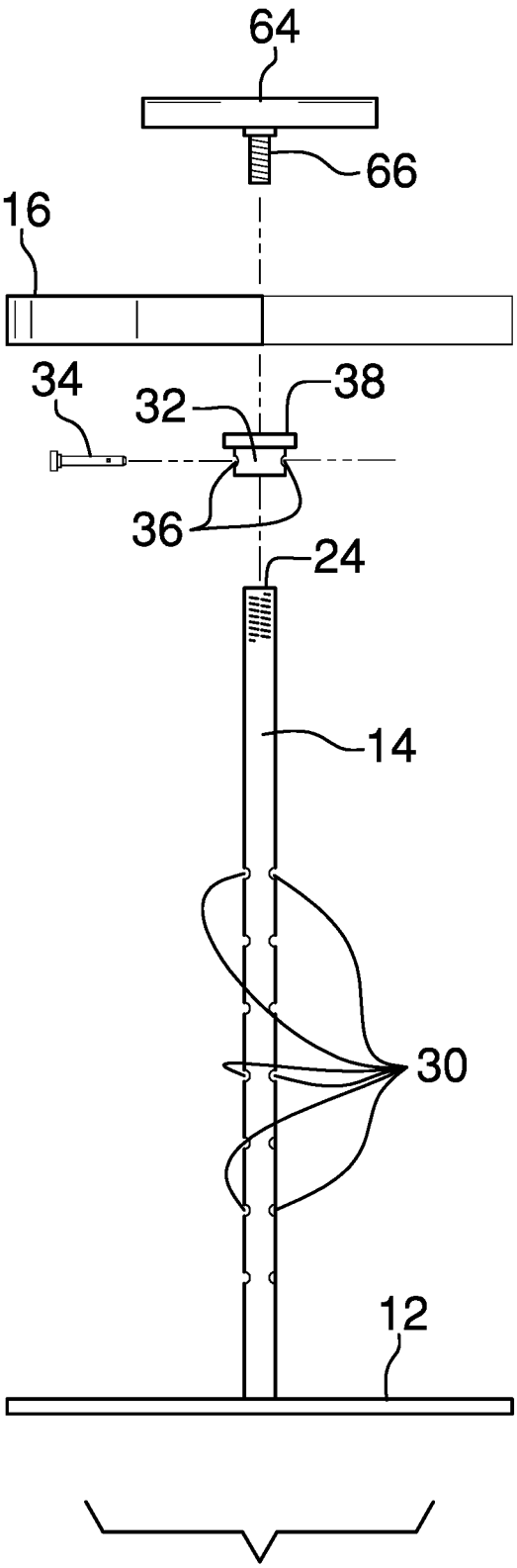
FIG. 5 is an exploded view of an embodiment of the disclosure.
Figure 6:
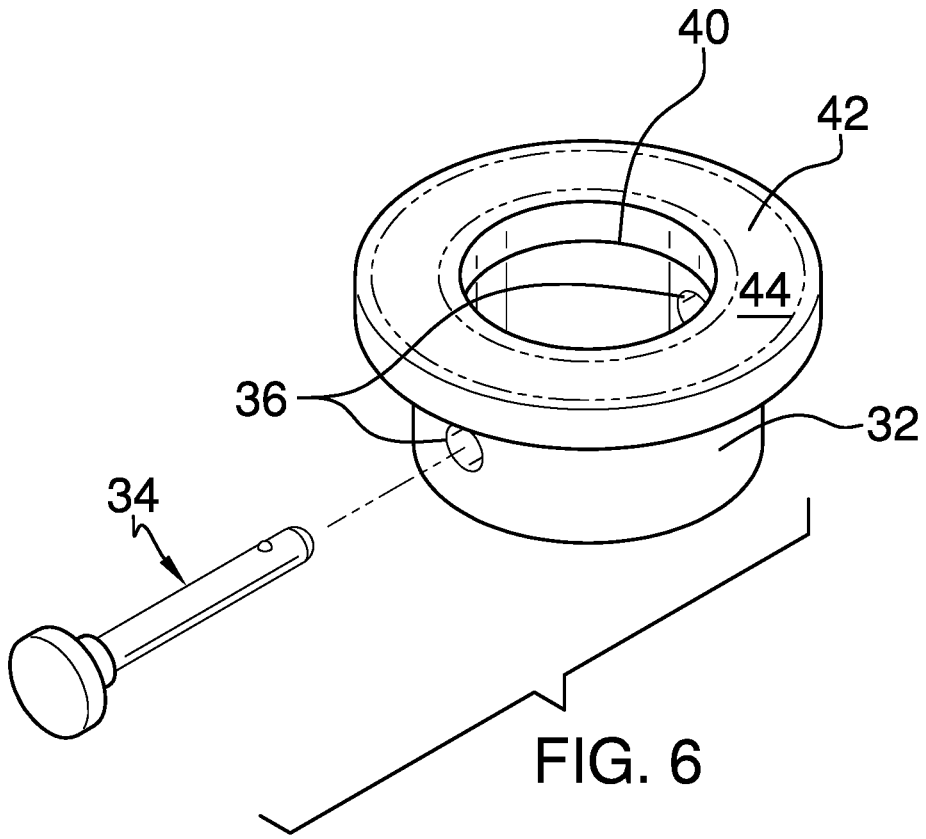
FIG. 6 is a detail view of an embodiment of the disclosure.

A rim 56 is coupled to and extends upwardly from the perimeter 54 of the panel 48. Each of a plurality of slats 58 is coupled to and extends between the rim 56 and the second tube 46 to define a plurality of compartments 60, as shown in FIG. 3. The plurality of compartments 60 comprises three compartments 60.

An organizer handle 62 is threadedly couplable to the upper end 24 of the spindle 14. The organizer handle 62 is configured to be grasped in a hand of the user to lift the spindle 14, the trays 16, and the items of the user. The user can remove the assembly 10 from the container 20 and position the base 12 on a surface, such as a tabletop, to allow the user access to each of the compartments 60 of each tray 16.

The organizer handle 62 comprises a first rod 64. A second rod 66 is coupled to and extends perpendicularly from the first rod 64. The second rod 66 is positioned equally distant from opposing ends 68 of the first rod 64. The second rod 66 is threaded. The first rod 64 is configured to be grasped in the hand of the user, positioning the user to threadedly insert the second rod 66 into the upper end 24 of the spindle 14 to couple the organizer handle 62 to the spindle 14.

Figure 7:
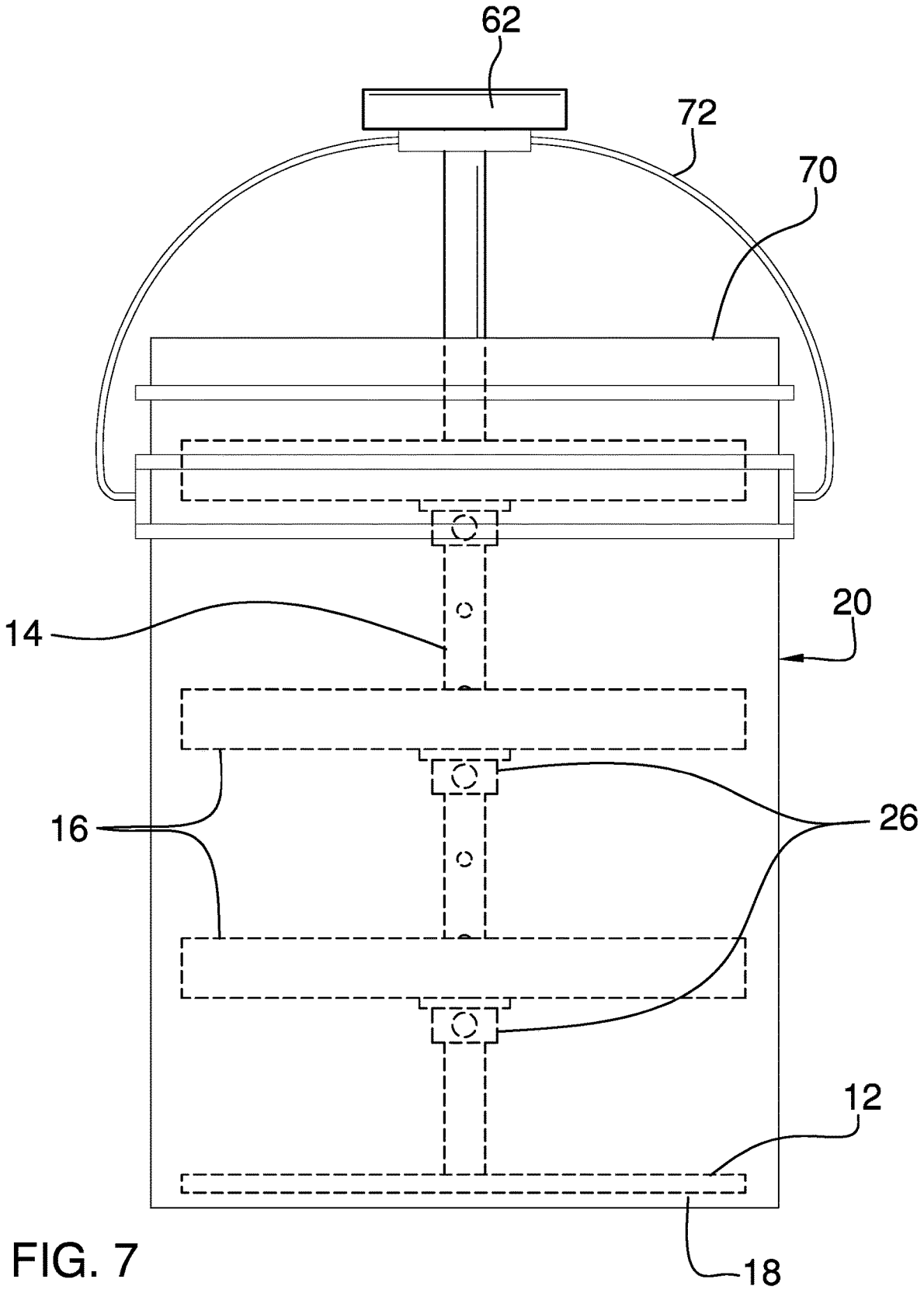
FIG. 7 is an in-use view of an embodiment of the disclosure.

The spindle 14 is sized to extend past an upper limit 70 of the container 20 to proximate to a container handle 72 with the container handle 72 in a deployed configuration, as shown in FIG. 7. In this configuration, both the container handle 72 and the organizer handle 62 are configured to be grasped in the hand of the user to lift the container 20, the spindle 14, the trays 16, and the items of the user.

In use, the pair of apertures 36 that is positioned in a respective first tube 32 is aligned with respective pair of holes 30 that correspond to a first desired position for a tray 16. The pin 34 is inserted through the pair of apertures 36 and the respective pair of holes 30 to fixedly couple the coupler 26 to the spindle 14. The spindle 14 then is inserted through the second tube 46 of the tray 16 to position the tray 16 on the coupler 26. The process is repeated for the desired number of trays 16. The compartments 60 are configured to stow and organize the items of the user, and the organizer handle 62 is used to lift the assembly 10, along with the items, to selectively position the assembly 10 and the items in the container 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An organizing assembly comprising:

a base, the base being circularly shaped wherein the base is configured for positioning on a bottom of a container that is cylindrically shaped;

a spindle coupled to and extending axially from the base, the spindle being tubular;

a plurality of couplers removably couplable to the spindle;

a plurality of trays, the trays being circularly shaped;

a plurality of orifices, each orifice being centrally positioned in a respective tray such that the orifice is positioned for inserting the spindle positioning the respective tray on a respective coupler wherein the respective tray is configured for stowing and organizing items of a user;

a plurality of pairs of holes positioned in the spindle such that the holes of each pair of holes are opposingly positioned in the spindle; and each coupler comprising:

a first tube, a pair of apertures positioned in the first tube such that the pair of apertures is selectively alignable with a respective pair of holes, and a pin selectively positionable through the pair of apertures and the respective pair of holes for fixedly coupling the first tube to the spindle.

2. The assembly of claim 1, further including the base comprising a disc.

3. The assembly of claim 1, further comprising:

a flange coupled to and extending radially from an upper circumference of the first tube; and a bearing recessed into an upper face of the flange wherein the bearing is positioned for facilitating rotation of the respective tray relative to the spindle.

4. The assembly of claim 1, further including the pin being detent type.

5. The assembly of claim 1, further including each tray comprising:

a second tube sized complementarily to the spindle wherein the second tube is positioned for selectively inserting the spindle; and a panel coupled to and extending radially from a lower endpoint of the second tube.

6. The assembly of claim 5, further including a cutout extending between a perimeter of the panel and the second tube.

7. The assembly of claim 6, further including a rim coupled to and extending upwardly from the perimeter of the panel.

8. The assembly of claim 7, further including a plurality of slats, each slat being coupled to and extending between the rim and the second tube defining a plurality of compartments.

9. The assembly of claim 8, further including the plurality of compartments comprising three compartments.

10. The assembly of claim 3, further comprising:

the spindle having an upper end, the spindle being internally threaded adjacent to the upper end; and an organizer handle threadedly couplable to the upper end of the spindle wherein the organizer handle is configured for grasping in a hand of the user for lifting the spindle, the trays, and the items of the user.

11. The assembly of claim 10, further including the spindle being sized to extend past an upper limit of the container to proximate to a container handle with the container handle in a deployed configuration wherein both the container handle and the organizer handle are configured for grasping in the hand of the user for lifting the container, the spindle, the trays, and the items of the user.

12. The assembly of claim 10, further including the organizer handle comprising:

a first rod; and a second rod coupled to and extending perpendicularly from the first rod, the second rod being positioned equally distant from opposing ends of the first rod, the second rod being threaded wherein the first rod is configured for grasping in the hand of the user positioning the user for threadedly inserting the second rod in the upper end of the spindle for coupling the organizer handle to the spindle.

13. A container and organizing assembly combination comprising:

a container, the container being cylindrically shaped;

a base, the base being circularly shaped such that the base is complementary to a bottom of the container wherein the base is configured for positioning on the bottom;

a spindle coupled to and extending axially from the base;

a plurality of couplers removably couplable to the spindle;

a plurality of trays, the trays being circularly shaped;

a plurality of orifices, each orifice being centrally positioned in a respective tray such that the orifice is positioned for inserting the spindle positioning the tray on a respective coupler wherein the tray is configured for stowing and organizing items of a user;

a plurality of pairs of holes positioned in the spindle such that the holes of each pair of holes are opposingly positioned in the spindle; and each coupler comprising:

a first tube, a pair of apertures positioned in the first tube such that the pair of apertures is selectively alignable with a respective pair of holes, and a pin selectively positionable through the pair of apertures and the respective pair of holes for fixedly coupling the first tube to the spindle.

14. An organizing assembly comprising:

a base, the base being circularly shaped wherein the base is configured for positioning on a bottom of a container that is cylindrically shaped, the base comprising a disc;

a spindle coupled to and extending axially from the base, the spindle being tubular, the spindle having an upper end, the spindle being internally threaded adjacent to the upper end, the spindle being sized to extend past an upper limit of the container to proximate to a container handle with the container handle in a deployed configuration;

a plurality of pairs of holes positioned in the spindle such that the holes of each pair of holes are opposingly positioned in the spindle;

a plurality of couplers removably couplable to the spindle, each coupler comprising:

a first tube, a pair of apertures positioned in the first tube such that the pair of apertures is selectively alignable with a respective pair of holes, a pin selectively positionable through the pair of apertures and the respective pair of holes for fixedly coupling the first tube to the spindle, the pin being detent type, a flange coupled to and extending radially from an upper circumference of the first tube, and a bearing recessed into an upper face of the flange;

a plurality of trays, the trays being circularly shaped, each tray comprising:

a second tube sized complementarily to the spindle wherein the second tube is positioned for selectively inserting the spindle, a panel coupled to and extending radially from a lower endpoint of the second tube, a cutout extending between a perimeter of the panel and the second tube, a rim coupled to and extending upwardly from the perimeter of the panel, and a plurality of slats, each slat being coupled to and extending between the rim and the second tube defining a plurality of compartments, the plurality of compartments comprising three compartments;

a plurality of orifices, each orifice being centrally positioned in a respective tray such that the orifice is positioned for inserting the spindle positioning the respective tray on a respective coupler wherein the respective tray is configured for stowing and organizing items of a user; and an organizer handle threadedly couplable to the upper end of the spindle wherein the organizer handle is configured for grasping in a hand of the user for lifting the spindle, the trays, and the items of the user, the organizer handle comprising:

a first rod, and a second rod coupled to and extending perpendicularly from the first rod, the second rod being positioned equally distant from opposing ends of the first rod, the second rod being threaded wherein the first rod is configured for grasping in the hand of the user positioning the user for threadedly inserting the second rod in the upper end of the spindle for coupling the organizer handle to the spindle.

* * * * *